US010107141B2

(12) United States Patent
Max et al.

(10) Patent No.: US 10,107,141 B2
(45) Date of Patent: Oct. 23, 2018

(54) SEAL CONFIGURATIONS FOR TURBINE ASSEMBLY AND BEARING COMPARTMENT INTERFACES

(71) Applicant: UNITED TECHNOLOGIES CORPORATION, Farmington, CT (US)

(72) Inventors: Seth A. Max, Manchester, CT (US); Anthony P. Cherolis, Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 531 days.

(21) Appl. No.: 14/685,437

(22) Filed: Apr. 13, 2015

(65) Prior Publication Data

US 2016/0298473 A1 Oct. 13, 2016

(51) Int. Cl.
*F01D 25/16* (2006.01)
*F01D 25/18* (2006.01)

(52) U.S. Cl.
CPC ..... *F01D 25/162* (2013.01); *F01D 25/183* (2013.01); *F05D 2230/642* (2013.01); *F05D 2240/55* (2013.01); *F05D 2250/75* (2013.01)

(58) Field of Classification Search
CPC ..... F01D 25/162; F01D 25/183; F01D 25/28; F01D 9/023; F01D 11/005; F05D 2240/57; F05D 2250/75; F16J 15/002; F16J 15/021
USPC ..... 415/170
See application file for complete search history.

(56) References Cited

U.S. PATENT DOCUMENTS 4,438,939 A * 3/1984 Pask ..... F01D 11/025 277/644
5,145,316 A * 9/1992 Birch ..... F01D 5/225 415/173.1
9,328,626 B2 * 5/2016 Duelm ..... F01D 25/08

* cited by examiner

*Primary Examiner* — Igor Kershteyn
*Assistant Examiner* — Brian P Wolcott
(74) *Attorney, Agent, or Firm* — Cantor Colburn LLP

(57) ABSTRACT

The present disclosure relates to gas turbine engine and seal configurations, and components for a gas turbine engine. In one embodiment, a seal for a gas turbine engine includes a first circumferential seal, a second circumferential seal and a seal support structure configured to retain at least a portion of each of the first and second seals. The seal support structure is mounted between a turbine assembly and bearing compartment, and wherein the first and second seals provide barriers to a cavity between the turbine assembly and bearing compartment.

18 Claims, 4 Drawing Sheets

SEAL CONFIGURATIONS FOR TURBINE ASSEMBLY AND BEARING COMPARTMENT INTERFACES

FIELD

The present disclosure relates to seal configurations for gas turbine engines and, in particular, to seal configurations with circumferential seal elements for a turbine assembly bearing compartment interface.

BACKGROUND

Gas turbine engines are required to operate efficiently during operation and flight. These engines create a tremendous amount of force and generate high levels of heat. As such, components of these engines are subjected to high levels of stress, temperature and pressure. It is necessary to provide components that can withstand the demands of a gas turbine engine.

Conventional configurations for gas turbine engines include multiple types of seal arrangements. Certain sections and compartments of a gas turbine engine may be provided with improved sealing configurations to improve at least one of efficiency, operation and safety of a gas turbine engine. There is also a desire to provide improved sealing configurations.

BRIEF SUMMARY OF THE EMBODIMENTS

Disclosed and claimed herein are components and configurations for gas turbine engines and gas turbine engines including seals. One embodiment is directed to a seal for a gas turbine engine including a first circumferential seal, a second circumferential seal, and a seal support structure configured to retain at least a portion of each of the first and second seals, wherein the seal support structure is mounted between a turbine assembly and bearing compartment, and wherein the first and second seals provide barriers to a cavity between the turbine assembly and bearing compartment.

In one embodiment, the first and second seals are W seals.

In one embodiment, the first and second seals are retained by the seal support structure in a co-planar arrangement.

In one embodiment, trailing edges of the first circumferential seal and the second circumferential seal are retained by the bearing compartment.

In one embodiment, the first circumferential seal is configured with a radius larger than the second circumferential seal.

In one embodiment, the first circumferential seal, second circumferential seal and seal support structure are aft of the turbine assembly and forward of the bearing compartment.

In one embodiment, the seal support structure is an annular structure.

In one embodiment, the seal support structure includes a plurality of channels to receive leading edges of the first and second circumferential seals and wherein the trailing edge of the first and second circumferential seals are engaged by the bearing compartment.

In one embodiment, seal is configured to seal a cavity between a high pressure turbine and bearing compartment associated with an inner case of the gas turbine engine.

In one embodiment, the seal is configured for a mid-turbine frame configuration of a gas turbine engine.

Another embodiment is directed to a gas turbine engine including a turbine assembly, a bearing compartment, and a seal between the turbine assembly and bearing compartment. The seal includes a first circumferential seal, a second circumferential seal, and a seal support structure configured to retain at least a portion of each of the first and second seals. The seal support structure is mounted between a turbine assembly and bearing compartment, and wherein the first and second seals provide barriers to a cavity between the turbine assembly and bearing compartment.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of this disclosure relates to configurations for gas turbine engines and gas turbine engine seals. In one embodiment, a configuration is provided to seal between a turbine assembly, such as a high pressure turbine, and a bearing compartment. The seal configuration may be employed for mid-turbine frame configurations of gas turbine engines.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1:
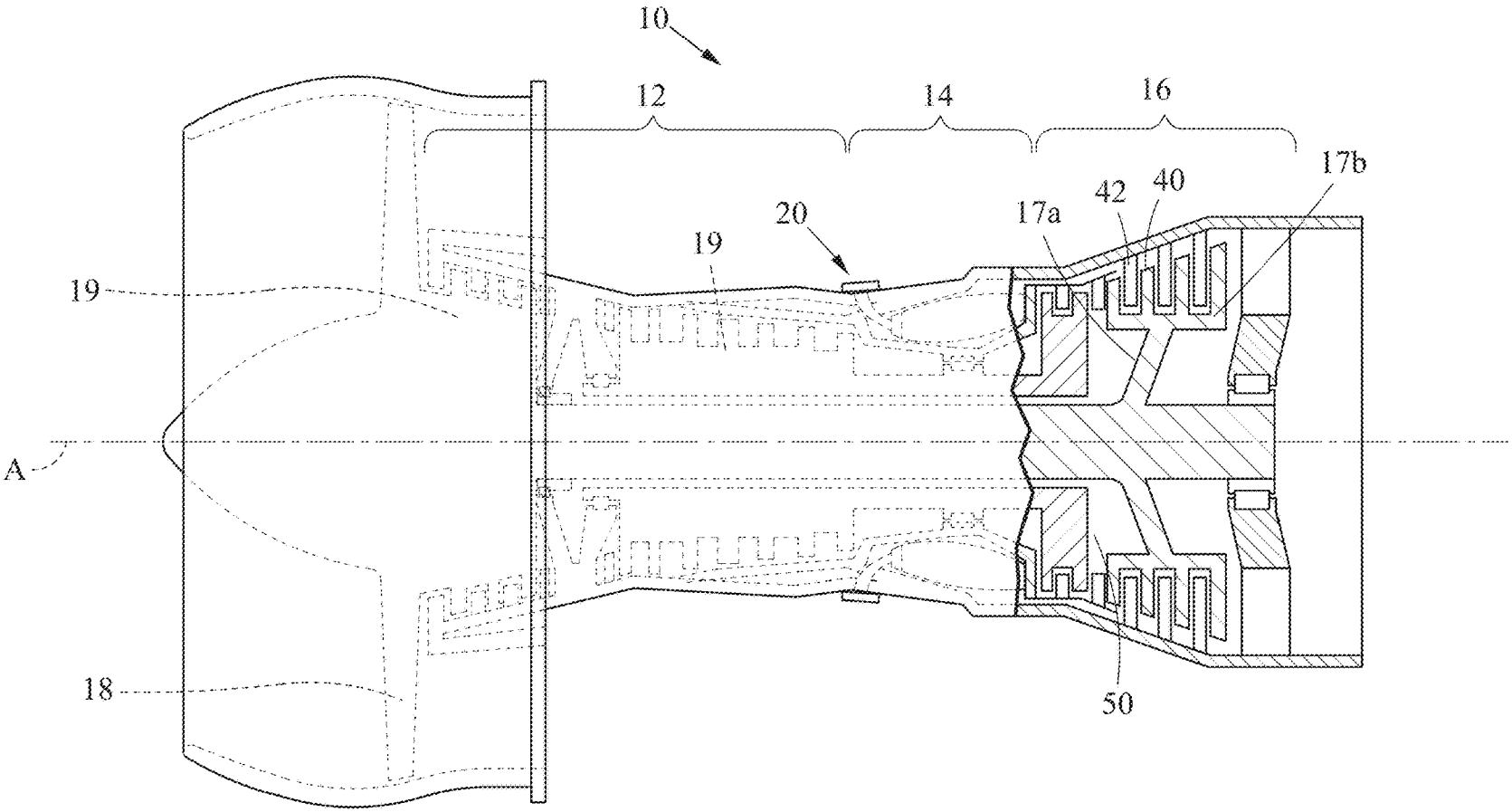
FIG. 1 depicts a graphical representation of a gas turbine engine according to one or more embodiments.

FIG. 1 depicts a graphical representation of a gas turbine engine according to one or more embodiments. Gas turbine engine 10 may be a turbofan gas turbine engine and is shown with reference engine centerline A. Gas turbine engine 10 includes compressor 12, combustion section 14, turbine section 16, fan 18 and casing 20. Air compressed by compressor 12 is mixed with fuel which is burned in the combustion section 14 and expanded to turbine section 16. The turbine section 16 includes rotors 17*a*-17*b* that rotate in response to the expansion and can drive compressor rotors 19 and fan 18. Turbine rotors 17*a*-17*b* carry blades 40. Fixed vanes 42 are positioned intermediate rows of blades 40. Turbine rotors 17*a* may relate to rotors of a high pressure turbine (HPT) and turbine rotors 17*b* may relate to rotors of a low pressure turbine (LPT).

According to one embodiment, gas turbine engine 10 may be configured with a mid-turbine frame configuration 50. A mid-turbine frame (MTF) configuration 50, or interturbine frame, is located generally between a high turbine stage (e.g., turbine rotors 17*a*) and a low pressure turbine stage (e.g., turbine rotors 17*b*) of gas turbine engine 10 to support one or more bearings and to transfer bearing loads through to an outer engine case 20. The mid-turbine frame configuration 50 is a load bearing structure. According to one embodiment, gas turbine engine 10 includes a seal configuration for a mid-turbine frame configuration 50.

Figure 2:
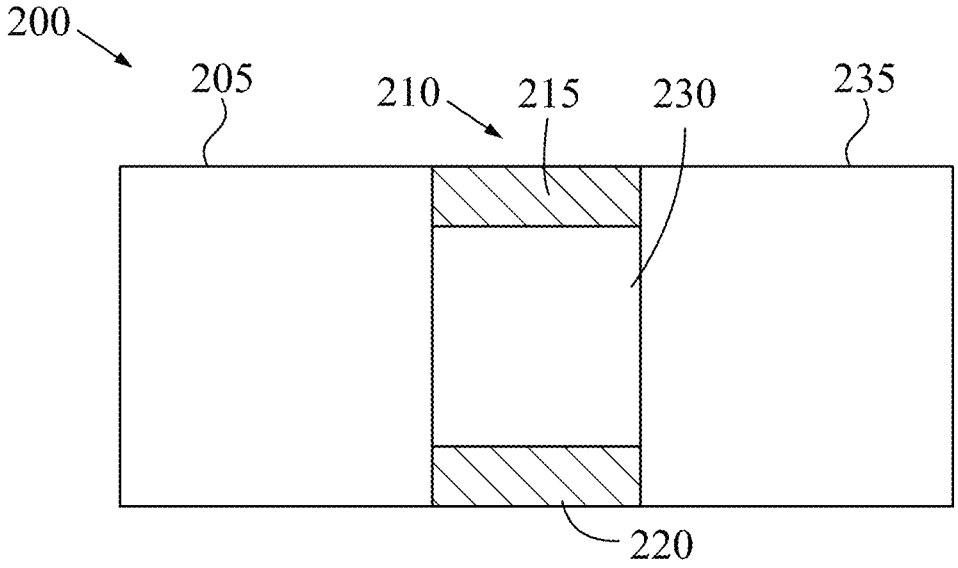
FIG. 2 depicts a graphical representations of a seal configuration according to one or more embodiments.

FIG. 2 depicts a graphical representation of a seal configuration according to one or more embodiments. Seal configuration 200 is a simplified representation, the sealing configuration including seal 210 relative to a mid-turbine assembly 205 and bearing compartment support 235. According to one embodiment, seal 210 includes a first circumferential seal 215 and a second circumferential seal 220. Seals 215 and 220 may be separated by a cavity 230. According to one embodiment, seal 215 and seal 220 may be retained by a seal support structure (not shown in FIG. 2). Seal 210 is mounted between a mid-turbine assembly 205 and bearing compartment support 235. Seal 215 and seal 220 create a cavity 230 between the mid-turbine assembly 205 and bearing compartment support 235. According to one embodiment, seal 215 and seal 220 are W seals. It should be appreciated that seal configuration 200 may include other types of seals. Seal 215 and seal 220 can seal an inner cavity, which may be a torque box cavity (e.g., torque box cavity 525), from a HPT rotor cavity 325. Each of seal 215 and seal 220 may be thin sheet metal. By providing a dual seal arrangement, sealing ability and capability to withstand a high temperature event is increased. The configuration of seal 215 and seal 220 as a dual seal arrangement provides redundancy if one seal cracks due to fatigue or material defect.

Figure 3:
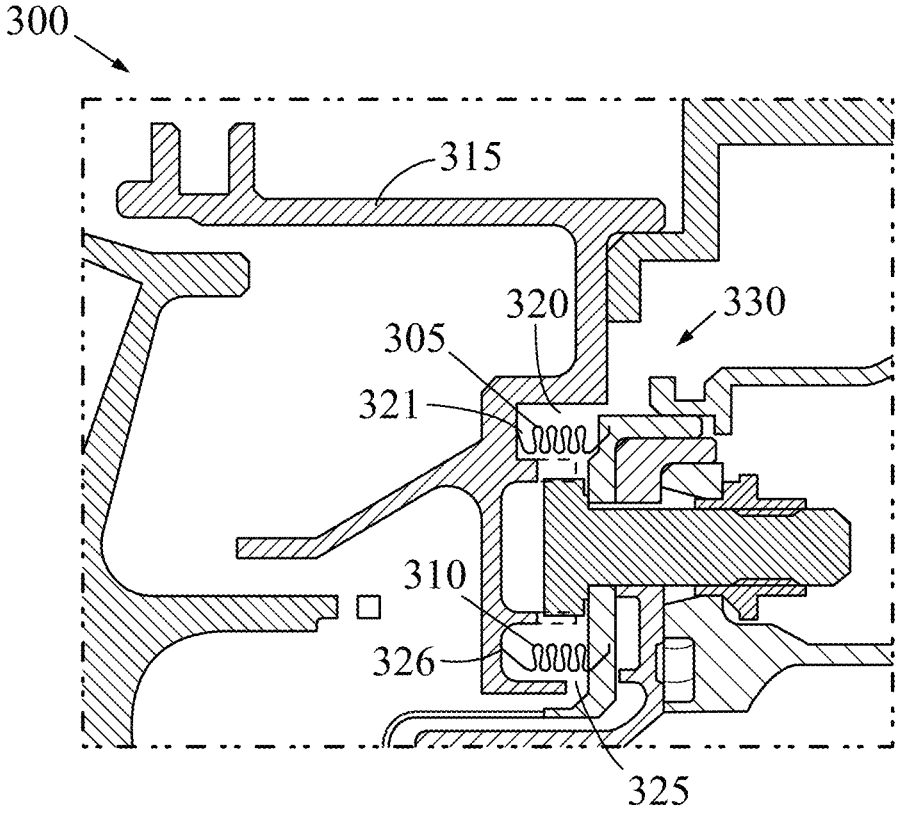
FIG. 3 depicts a graphical representation of a seal configuration according to one or more embodiments.

FIG. 3 depicts a graphical representation of a seal configuration according to one or more embodiments. Seal configuration 300 is shown relative to a cross section of a mid-turbine frame gas turbine engine. Seal configuration 300 includes seals 305 and 310, which may be circumferential seals (e.g., W seals, C seals, etc.) retained by seal support structure 315. According to one embodiment, seal support structure 315 is configured to retain at least a portion of each of the seals 305 and 310 in cavities 320 and 325 respectively. In an alternative embodiment, seal support structure 315 is configured to retain the portion of each seal 305 and 310 in cavities provided by a bearing compartment support (e.g., bearing compartment support 235). Seal 305 is configured with a radius larger than the seal 310. Seal support structure 315 is an annular structure.

Seals 305 and 310 are aft of a turbine assembly and forward of the bearing compartment 330. Seal support structure 315 includes a plurality of channels, such as channel 320 and 325 to receive leading edges 321 and 326 of the seals 305 and 310, respectively. The trailing edge of seals 305 and 310 are engaged by the bearing compartment 330.

Figure 4B:
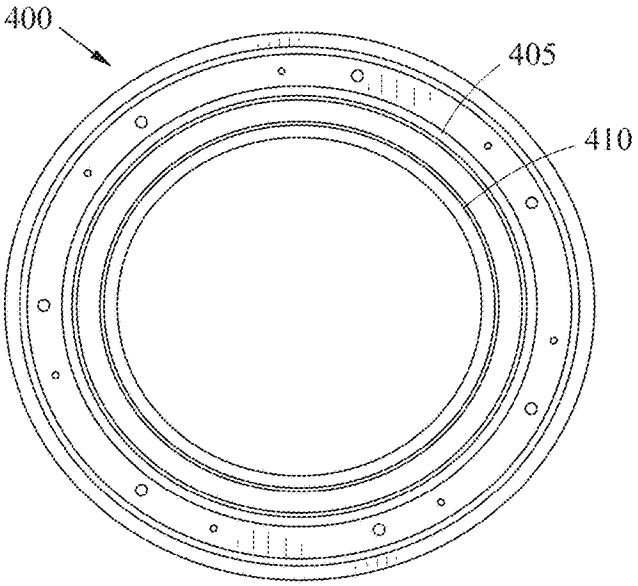
FIGS. 4A-4B depict graphical representations of seal configurations according to one or more embodiments.
Figure 4A:
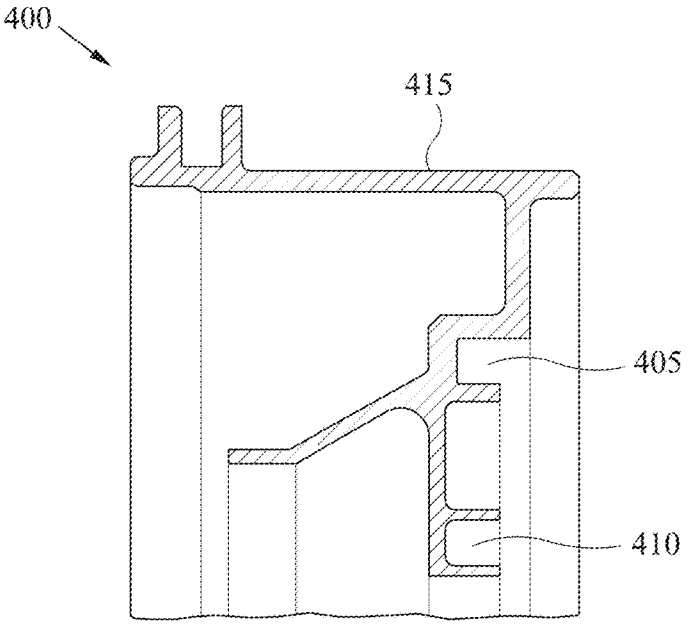

FIGS. 4A-4B depict graphical representations of seal configurations according to one or more embodiments. Seal support structure 400 is shown according to one or more embodiments. Seal support structure 400 includes first channel 405 to receive a first seal, a second channel 410 to receive a second seal and seal mounting portion 415. Channels 405 and 410 are each configured to retain at least a portion of a seal. FIG. 4B depicts the aft surface of seal support structure 400 with channels 405 and 410. Seal support structure 400 is an annular structure. Seal support structure 400 is configured to seal a cavity between a high pressure turbine and bearing compartment associated with an inner case of the gas turbine engine.

Figure 5:
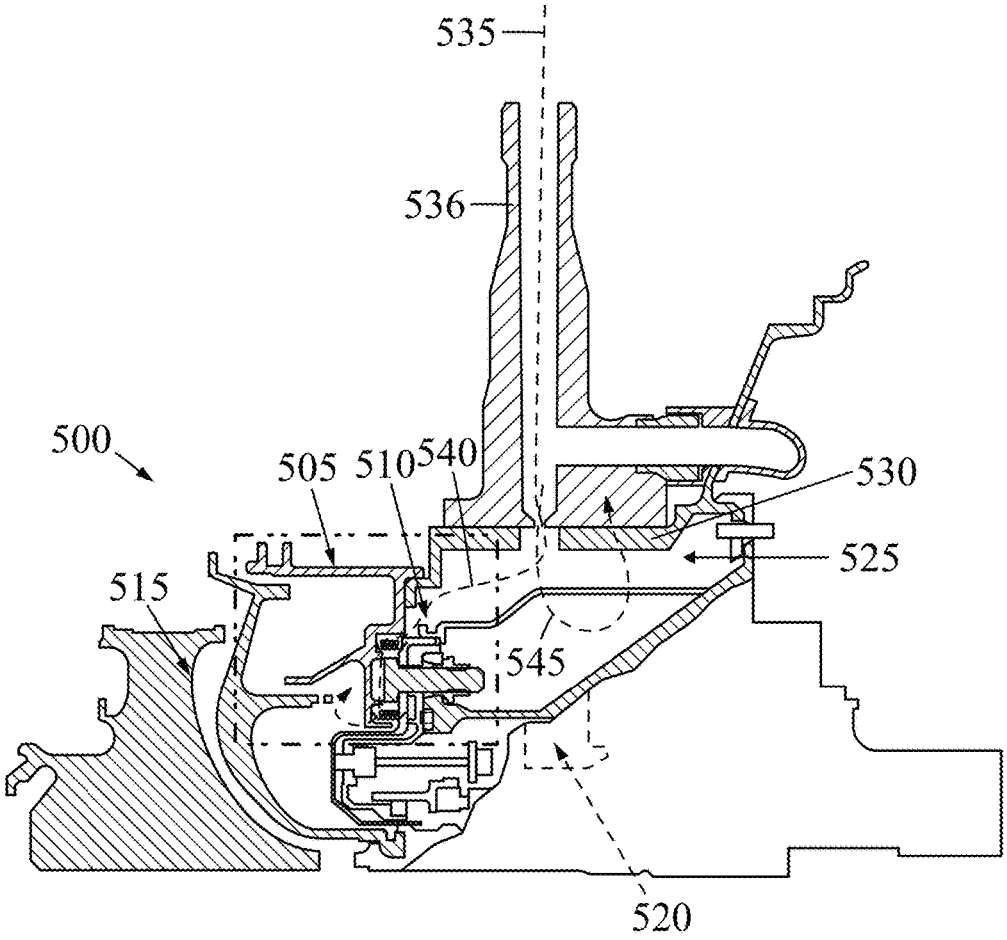
FIG. 5 depicts a graphical representation of a mid-turbine frame configuration according to one or more embodiments.

FIG. 5 depicts a graphical representation of a mid-turbine frame configuration according to one or more embodiments. A portion of a gas turbine engine is shown as 500 including a seal support 505 and seal configuration 510. Seal support 505 and seal configuration 510 are configured to seal between the mid-turbine assembly 515 and the bearing compartment support 520. Seal support 505 and seal configuration 510 are configured relative to a cavity 525 (e.g., torque box cavity) that is not air tight. Seal configuration 510 maintains an axial gap between the mid-turbine assembly 515 and the bearing compartment support 520 to allow for relative thermal growth. FIG. 5 depicts cooling flow 535 that comes out from a tie rod 536 to pressurize cavity 525. Cavity 525 may be an annular torque box cavity, between the inner case 530 and bearing compartment support 520. A small amount of flow coming into the cavity 525 leaks past the seal, shown as 540, into a rotor cavity for turbine assembly 515. Seal configuration 510 minimizes the leakage flow between the cavities of the mid-turbine arrangement.

According to one embodiment, in the case of a high temperature event, seal configuration 510 includes a seal close to cavity 525 and a backup seal close to turbine assembly 515 to prevent a direct path and/or leakage to the turbine assembly 515. Due to thermal growth, the inner case of turbine assembly 515 is hotter and grows more than bearing compartment 520. Bearing compartment support 520 and inner case 530 are tied together, such that seal configuration 510 allows for sealing between the two compartments. Cooling flow that is prevented from leaking through the seal configuration 510 passes radially outward through holes in the inner case 530, shown as 545, and provides cooling and purge flow for mid-turbine frame assembly and mid-turbine vane (not shown).

While this disclosure has been particularly shown and described with references to exemplary embodiments thereof, it will be understood by those skilled in the art that various changes in form and details may be made therein without departing from the scope of the claimed embodiments.

What is claimed is:

1. A seal assembly for a gas turbine engine, the seal assembly comprising:

a first circumferential seal;

a second circumferential seal, wherein the second circumferential seal is a backup seal to the first circumferential seal;

a seal support structure having a plurality of channels to receive leading edges of the first and second circumferential seals; and wherein the seal support structure is mounted between a turbine assembly and a bearing compartment, and a trailing edge of each of the first and second circumferential seals is engaged by the bearing compartment, and wherein the first circumferential seal and the second circumferential seal provide barriers to a cavity between the turbine assembly and the bearing compartment.

2. The seal assembly of claim 1, wherein the first and second circumferential seals are W seals.

3. The seal assembly of claim 1, wherein the first and second circumferential seals are retained by the seal support structure in a co-planar arrangement.

4. The seal assembly of claim 1, wherein trailing edges of the first circumferential seal and the second circumferential seal are retained by the bearing compartment.

5. The seal assembly of claim 1, wherein the first circumferential seal is configured with a radius larger than the second circumferential seal.

6. The seal assembly of claim 1, wherein the first circumferential seal, the second circumferential seal and the seal support structure are aft of the turbine assembly and forward of the bearing compartment.

7. The seal assembly of claim 1, wherein the seal support structure is an annular structure.

8. The seal assembly of claim 1, wherein the seal assembly is configured to seal a cavity between a high pressure turbine and the bearing compartment associated with an inner case of the gas turbine engine.

9. The seal assembly of claim 1, wherein the seal assembly is configured for a mid-turbine frame configuration of a gas turbine engine.

10. A gas turbine engine comprising:

a turbine assembly;

a bearing compartment; and a seal assembly between the turbine assembly and bearing compartment, wherein the seal includes;

a first circumferential seal, a second circumferential seal, wherein the second circumferential seal is a backup seal to the first circumferential seal, a seal support structure having a plurality of channels to receive leading edges of the first and second circumferential seals; and wherein the seal support structure is mounted between a turbine assembly and a bearing compartment, and a trailing edge of each of the first and second circumferential seals is engaged by the bearing compartment, and wherein the first circumferential seal and the second circumferential seal provide barriers to a cavity between the turbine assembly and the bearing compartment.

11. The gas turbine engine of claim 10, wherein the first and second circumferential seals are W seals.

12. The gas turbine engine of claim 10, wherein the first and second circumferential seals are retained by the seal support structure in a co-planar arrangement.

13. The gas turbine engine of claim 10, wherein trailing edges of the first circumferential seal and the second circumferential seal are retained by the bearing compartment.

14. The gas turbine engine of claim 10, wherein the first circumferential seal is configured with a radius larger than the second circumferential seal.

15. The gas turbine engine of claim 10, wherein the first circumferential seal, second circumferential seal and seal support structure are aft of the turbine assembly and forward of the bearing compartment.

16. The gas turbine engine of claim 10, wherein the seal support structure is an annular structure.

17. The gas turbine engine of claim 10, wherein the seal assembly is configured to seal a cavity between a high pressure turbine and the bearing compartment associated with an inner case of the gas turbine engine.

18. The gas turbine engine of claim 10, wherein the seal assembly is configured for a mid-turbine frame configuration of a gas turbine engine.

* * * * *